US006702598B1

(12) United States Patent
Lo

(10) Patent No.: US 6,702,598 B1
(45) Date of Patent: Mar. 9, 2004

(54) MEMORY CARD CONNECTOR

(75) Inventor: Chi Cheng Lo, Shu-Lin (TW)

(73) Assignee: Fang Tien Huang, Taipei (TW)

( * ) Notice: Subject to any disclaimer, the term of this patent is extended or adjusted under 35 U.S.C. 154(b) by 0 days.

(21) Appl. No.: 10/386,497

(22) Filed: Mar. 13, 2003

(51) Int. Cl.[7] ..... H01R 13/62
(52) U.S. Cl. ..... 439/157; 439/328
(58) Field of Search ..... 439/157, 159, 439/160, 152–156, 326, 329, 372, 325, 328

(56) References Cited

U.S. PATENT DOCUMENTS 5,302,133 A * 4/1994 Tondreault ..... 439/157
5,443,394 A * 8/1995 Billman et al. ..... 439/157
5,690,499 A * 11/1997 Howell et al. ..... 439/157
6,200,149 B1 * 3/2001 Chi-Chung ..... 439/160

FOREIGN PATENT DOCUMENTS

CN 86215242 6/1999
CN 87201718 8/1999

* cited by examiner

*Primary Examiner*—Hien Vu
(74) *Attorney, Agent, or Firm*—Troxell Law Office PLLC

(57) ABSTRACT

The connector comprises an elongated slot and two end shoulders each including two arms, a groove between the arms, two flexible spaced walls behind the groove, two inner indentations, a hole recessed into either indentation, and a cavity; and two fastening mechanisms each including a trigger member, an inward protrusion, a latched piece at either side below the protrusion, a lower inward projection, and two pivot bars below the latched piece, the pivot bars being fitted into the holes for pivotably connecting the fastening mechanisms in the cavity. In fastening align pins of the card with the slot prior to insertion and pivot the fastening mechanisms inward until the protrusions are snapped into side recesses of the card and the latched pieces are urged against the walls respectively, thereby further inserting the pins into the slot for widthwise and lengthwise fastening the card.

5 Claims, 7 Drawing Sheets

A-A

B-B

C-C

MEMORY CARD CONNECTOR

BACKGROUND OF THE INVENTION

1. Field of the Invention

The present invention relates to connectors and more particularly to a memory card connector with improved characteristics.

2. Description of Related Art

Conventionally, a memory card connector comprises an elongated body, a lengthwise, central slot on the body for receiving pins of a memory card, and two end shoulders each having a fastening mechanism for pivotably fastening the ends of the memory card. Following is a description of a number of conventional memory card connectors: For example, Taiwanese Patent Published No. 362,827 discloses, in its FIG. 9, showing a conventional memory card connector having closed end shoulders for fastening the memory card fitted in the slot. However, the memory card tends to loosen widthwise after a short period of time of use due to its closed end shoulders, even there are two locks provided at the shoulders they still cannot reliably fasten the memory card therein. Although Taiwan Patent Published No. 362,827, in order to improve the fastening mechanism for pivotably fixing both ends of the memory card by providing a non-closed end shoulders, however, a gap in the shoulders is wider than a thickness of the memory card received therein. As a result, the memory card also tends to loosen widthwise, an electrical connection between the memory card and the connector may fail. Moreover, Taiwanese Patent Published No. 366,144 discloses a similar locking mechanism in either end of the body for pivotably fastening the memory card fitted in the slot. However, it only provides a lengthwise fastening to the memory card. Hence, the memory card also tends to loosen widthwise after a short period of time of use. Additionally, an enhancement of the widthwise fastening to the memory card may degrade the lengthwise fastening thereof. As a result, an electrical connection between the memory card and the connector may also fail. Thus, the need for improvement still exists.

SUMMARY OF THE INVENTION

It is an object of the present invention to provide a connector for fastening a rectangular memory card including a plurality of pins at a lower side and a recess at either side. The connector comprises an elongated body including a lengthwise, central slot, two bases spaced apart by the slot, a plurality of conductive apertures on either base, and two shoulders at ends of the body, each shoulder including two arms facing the slot, a groove between the arms, two L-shaped flexible walls on a back of the groove, a slit between the walls, two wells spaced apart by the walls, two indentations adjacent the wells, a hole recessed into either indentation, and a cavity; and two fastening mechanisms each including a top trigger member, an upper inward protrusion, a latched piece at either side below the protrusion, a lower inward projection, and two cylindrical pivot bars below the latched piece, the pivot bars being fitted into the holes for pivotably connecting the fastening mechanisms in the cavity; wherein in fastening align the pins of the memory card with the slot prior to insertion, the insertion will be stopped once the memory card contacts the projections, and pivot the fastening mechanisms inward until the protrusions are snapped into the recesses and the latched pieces are urged against the walls respectively, thereby further inserting the pins into the slot, fastening the memory card widthwise and lengthwise, and electrically connecting the pins to the conductive apertures.

In one aspect of the present invention, there is provided a slit between two walls becoming narrow responsive to the walls being urged toward each other by a compression of the latched pieces to further provide the lengthwise and widthwise fastening for the memory card and the connector.

In another aspect of the present invention there is further provided two abutment members each between the latched piece and the pivot bar, the abutment members being urged against rear corners of the indentations for firmly holding thereto.

The above and other objects, features and advantages of the present invention will become apparent from the following detailed description taken with the accompanying drawings.

DETAILED DESCRIPTION OF THE PREFERRED EMBODIMENTS

Figure 1:
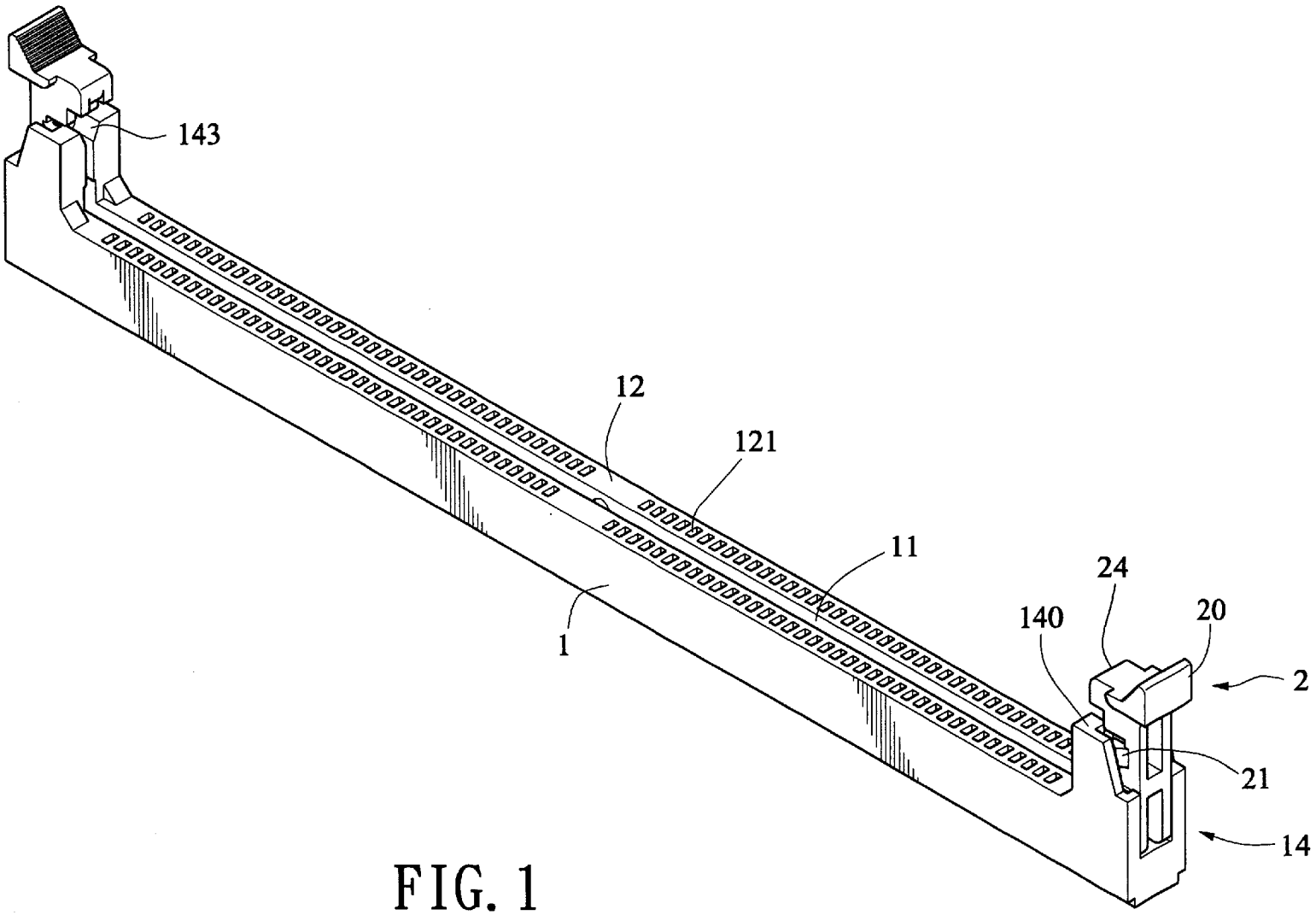
FIG. 1 is a perspective view of a preferred embodiment of memory card connector according to the invention.
Figure 2:
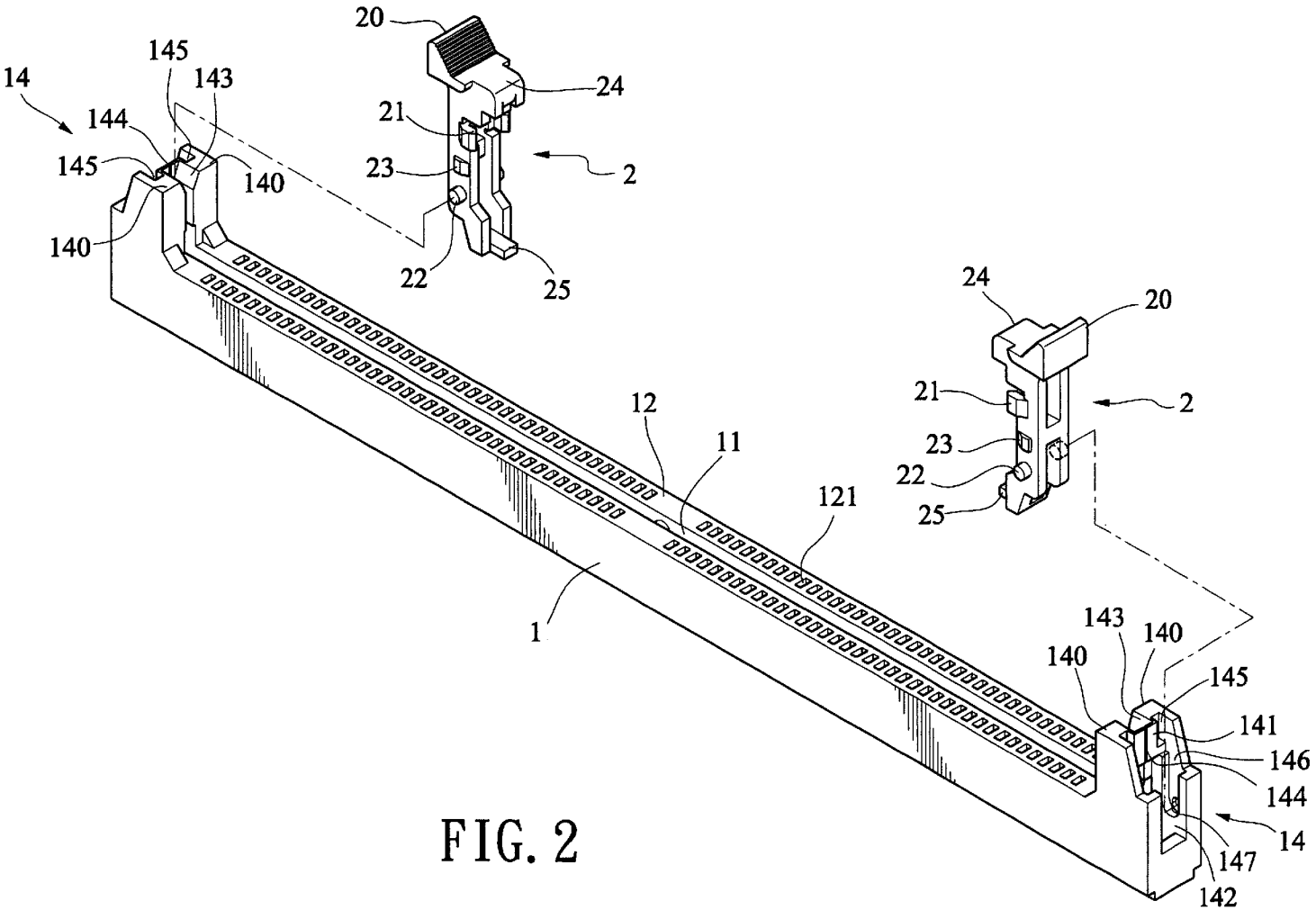
FIG. 2 is an exploded perspective view of FIG. 1.

Referring to FIGS. 1, 2, 3A, and 3B, there is shown a memory card connector constructed in accordance with the invention. The connector comprises an elongated body 1, a lengthwise, central slot 11 on the body 1 for receiving pins 31 of a memory card 3, two bases 12 spaced apart by the slot 11, a plurality of conductive apertures 121 on either base 12, two shoulders 14 at ends of the body 1, each shoulder 14 including two arms 140 facing the slot 11, a groove 143 between the arms 140, two L-shaped flexible walls 141 on the back of the groove 143, a slit 144 between the walls 141, two wells 145 spaced apart by the walls 141, two indentations 146 adjacent the outer side of the wells 145, a hole 147 recessed into either indentation 146 but not exposed to the outside, and a cavity 142, and two fastening mechanisms 2 each including a top trigger member 20, an upper protrusion 24 projected inward, a latched piece 21 having a rounded head at either side below the protrusion 24, two abutment members 23 below the latched pieces 21, two cylindrical pivot bars 22 below the abutment members 23, and a lower projection 25 projected inward.

Figure 3A:
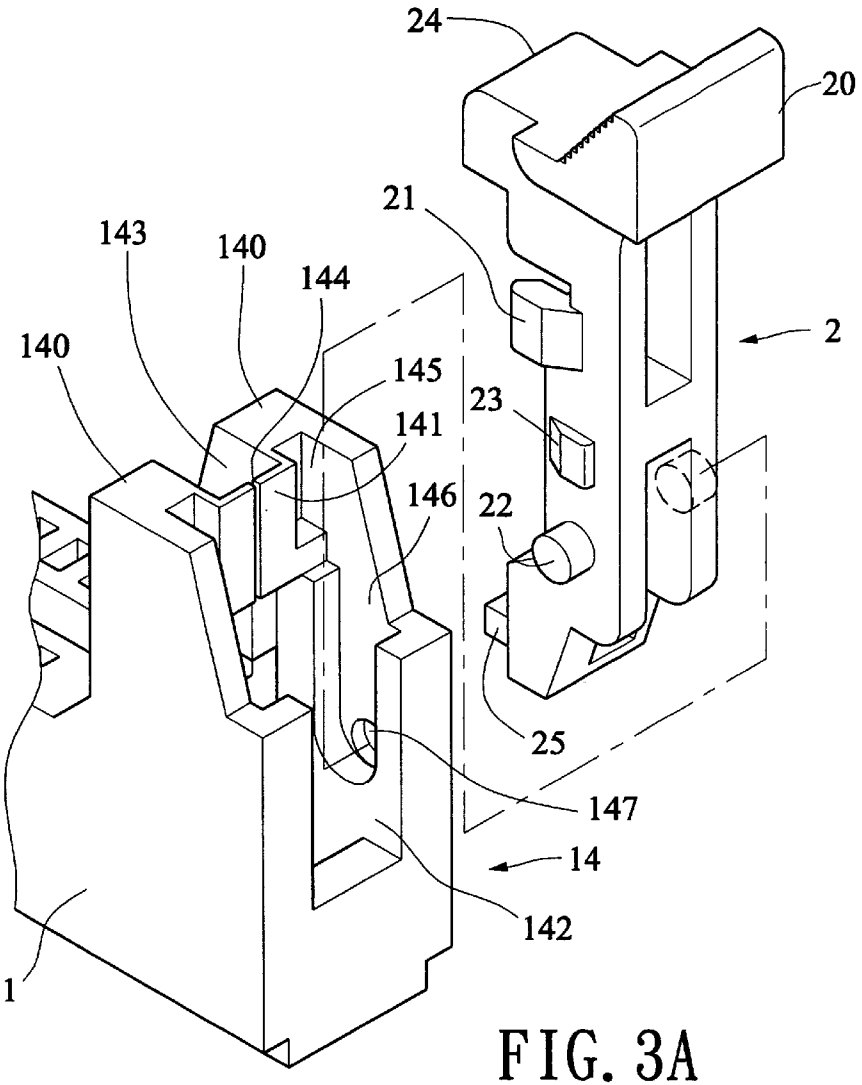
FIG. 3A is an exploded perspective view where a body of the connector and a fastening mechanism have not been fastened together.
Figure 3B:
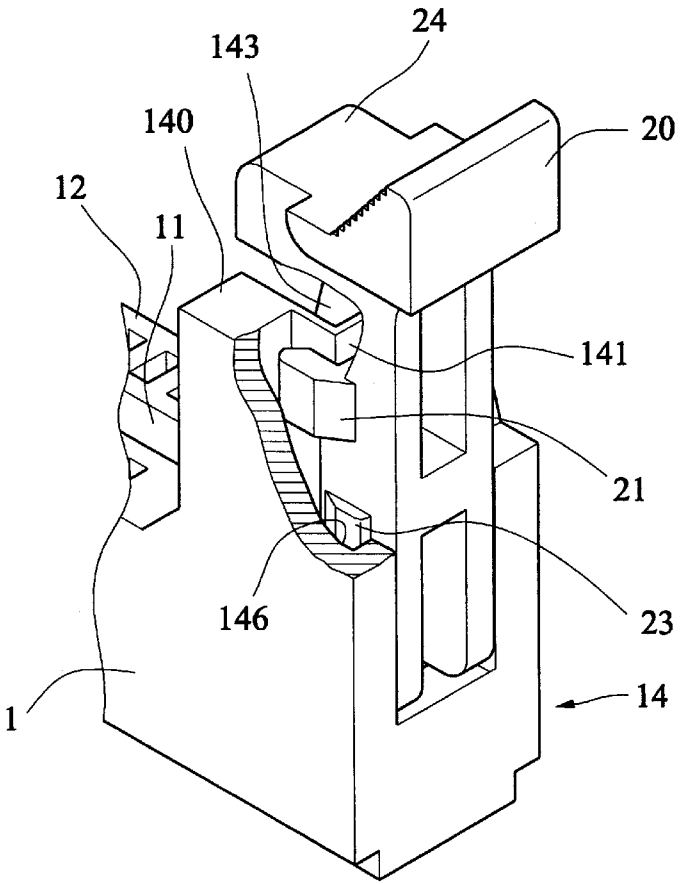
FIG. 3B is a view similar to FIG. 3A where the body of the connector and the fastening mechanism have been fastened together.
Figures 4, 5, 6:
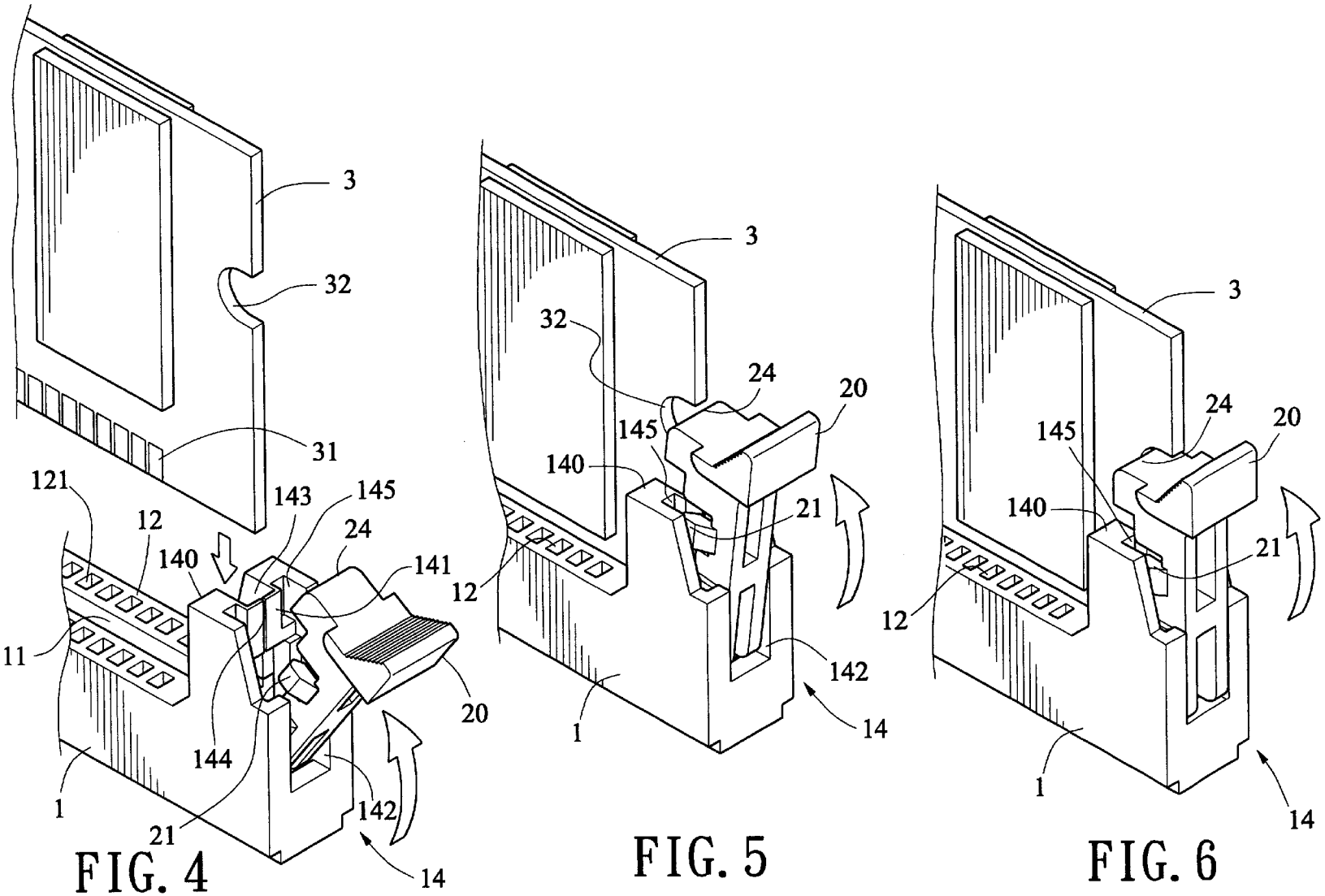
FIG. 4 is a partial perspective view where the memory card has not fitted in a slot of the connector.
FIG. 5 is a partial perspective view where the memory card has fitted in the slot of the connector but not fastened.
FIG. 6 is a partial perspective view where the memory card has fitted in a slot of the connector and fastened.
Figure 4A:
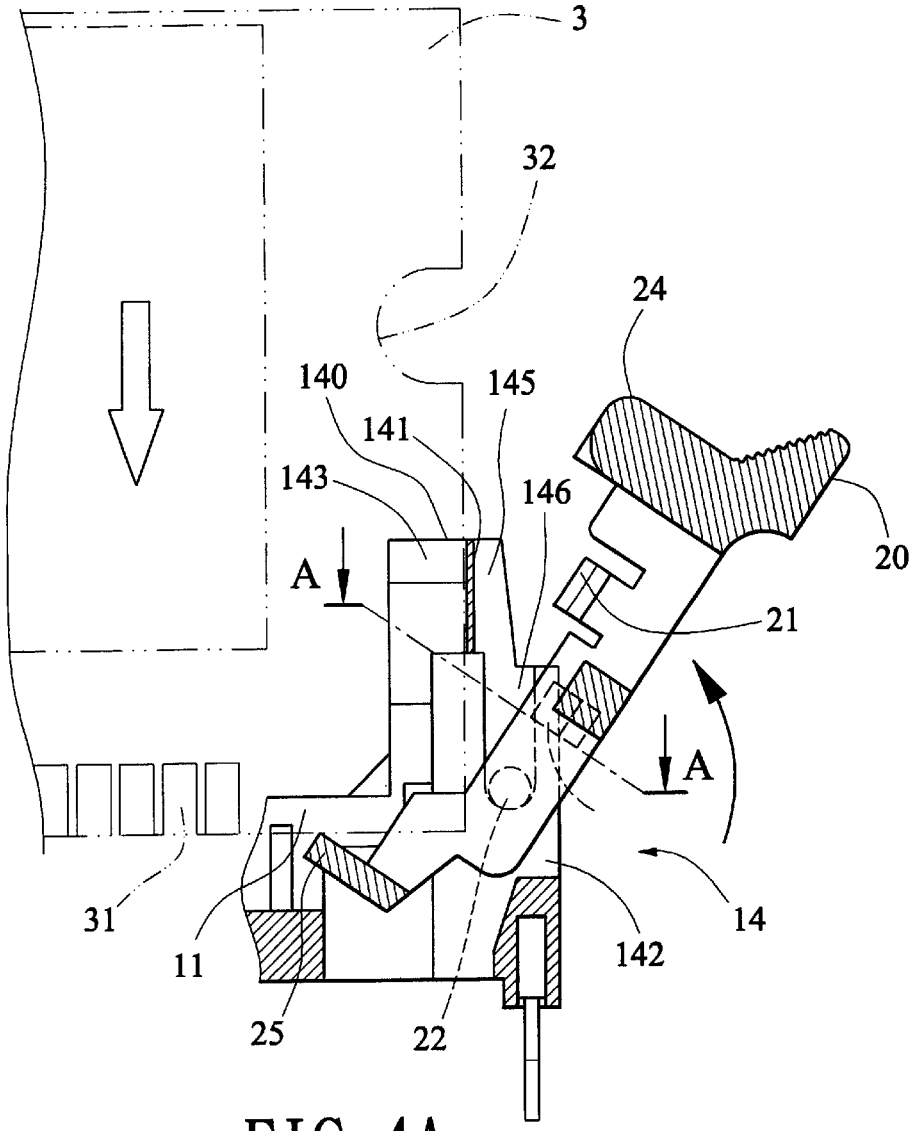
FIG. 4A is a cross-sectional view of FIG. 4.
Figure 4B:
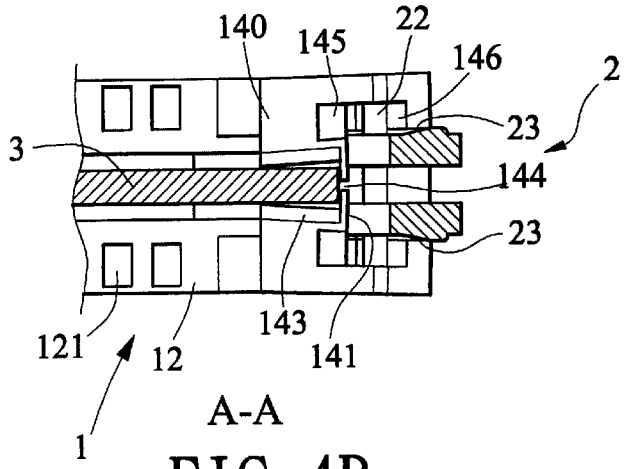
FIG. 4B is a cross-sectional view taken along line A—A of FIG. 4A.
Figure 5A:
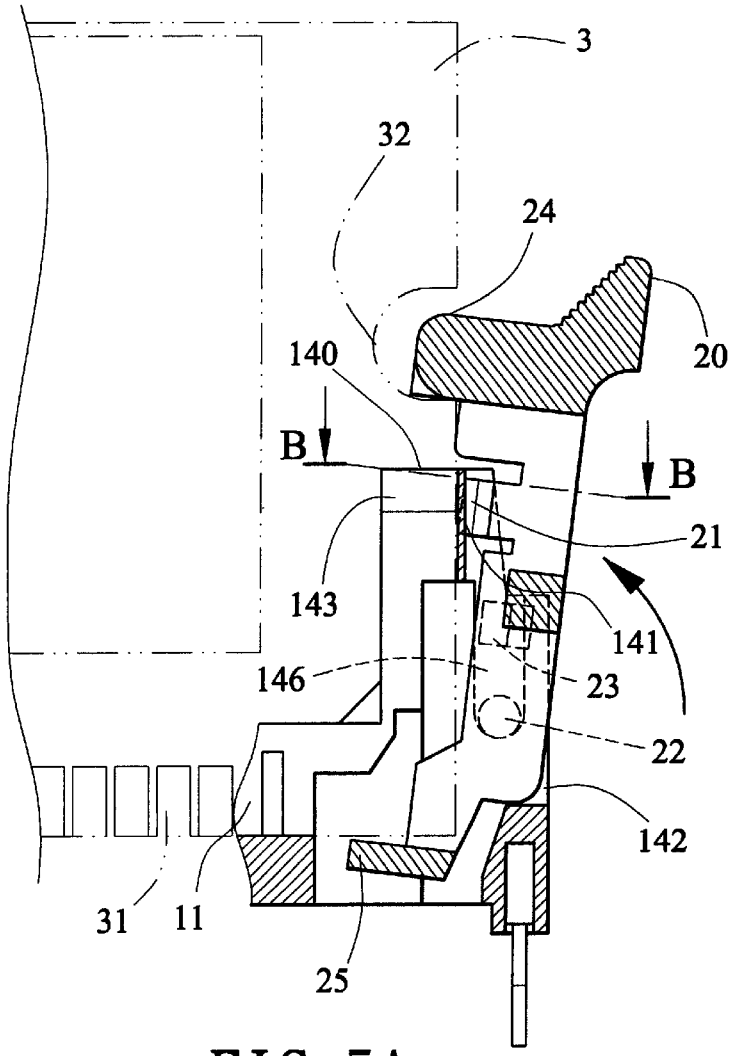
FIG. 5A is a cross-sectional view of FIG. 5.
Figure 5B:
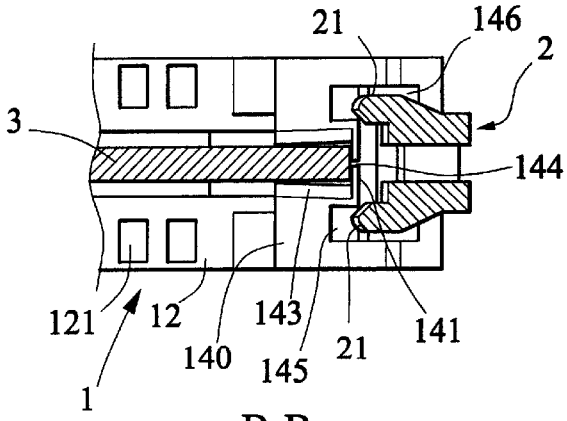
FIG. 5B is a cross-sectional view taken along line B—B of FIG. 5A.
Figure 6A:
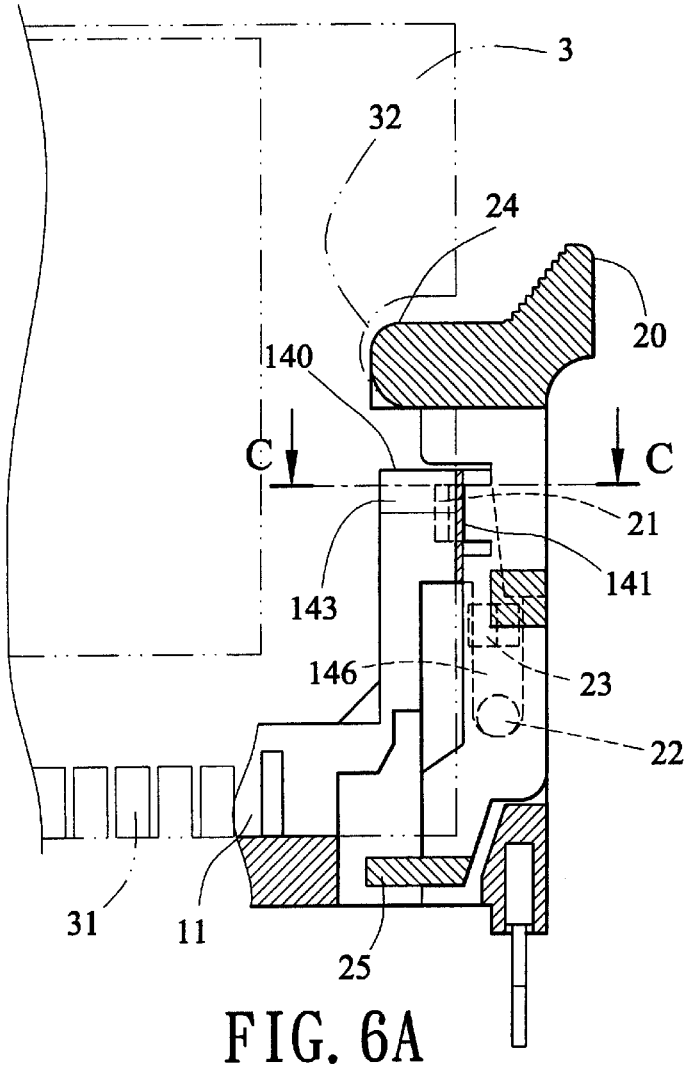
FIG. 6A is a cross-sectional view of FIG. 6.
Figure 6B:
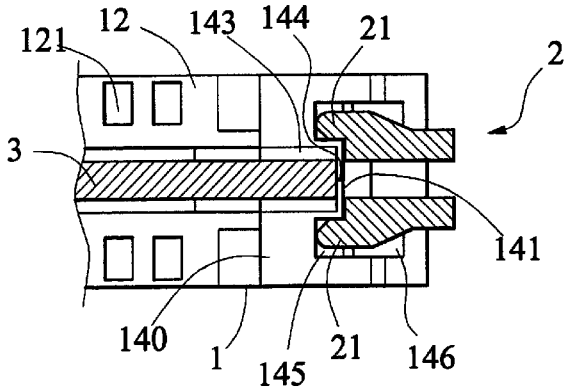
FIG. 6B is a cross-sectional view taken along line C—C of FIG. 6A.

Referring to FIGS. 4, 4A, 4B, 5, 5A, 5B, 6, 6A, and 6B, an assembly and fastening operation of the invention will now be described in detail below. First, insert the fastening mechanisms 2 into the cavity 142 until the fastening mechanisms 2 are stopped by the bottom of the cavity 142 and the cylindrical pivot bars 22 are fitted into the holes 147. As a result, the fastening mechanisms 2 are pivotal about the shoulders 14. Second, align the memory card 3 with the slot 11 and the groove 143 prior to insertion. The insertion will be stopped once the memory card 3 contacts the projections 25. Next, pivot the fastening mechanisms 2 inward by pushing the trigger members 20 inward until the protrusions 24 are snapped into side recesses 32 of the memory card 3, the abutment members 23 are urged against corners of the indentations 146 for firmly holding thereto (see FIG. 3B), and the latched pieces 21 are urged against the rear comer of the walls 141 respectively (as shown in FIGS. 3B, 6A and 6B). Note that the pins 31 of the memory card 3 are further inserted into the slot 11 during the process of snapping the protrusions 24 into the recesses 32. Also, as seen from FIG. 6B the slit 144 becomes narrow because the walls 141 are urged toward each other by the compression of the latched pieces 21. Thus, the memory card 3 is prevented from loosening widthwise and lengthwise. At this position, the pins 31 are electrically connected to the conductive apertures 121. Most importantly, the electrical connection is secure because the memory card 3 is fastened widthwise and lengthwise by the fastening mechanisms 2 in accordance with the invention.

While the invention herein disclosed has been described by means of specific embodiments, numerous modifications and variations could be made thereto by those skilled in the art without departing from the scope and spirit of the invention set forth in the claims.

What is claimed is:

1. A connector for fastening a memory card including a plurality of pins at a lower side and a locking recess at either side, the connector comprising:

an elongated body including a lengthwise, central slot, two bases spaced apart by the slot, a plurality of conductive apertures on either base, and two shoulders at ends of the body, each shoulder including two arms facing the slot, a groove between the arms, two L-shaped flexible walls on a back of the groove, a slit between the walls, two wells spaced apart by the walls, two indentations adjacent the wells, a hole recessed into either indentation, and a cavity; and two fastening mechanisms each including a top trigger member, an upper inward protrusion, a latched piece at either side below the protrusion, a lower inward projection, and two cylindrical pivot bars below the latched piece, the pivot bars being fitted into the holes in the indentation for pivotably connecting the fastening mechanisms in the cavity;

wherein in fastening align the pins of the memory card with the slot prior to insertion, the insertion will be stopped once the memory card contacts the projections, and pivot the fastening mechanisms inward until the protrusions are snapped into the recesses of the memory card and the latched pieces are urged against the flexible walls respectively, thereby further inserting the pins into the slot, fastening the memory card widthwise and lengthwise, and electrically connecting the pins to the conductive apertures.

2. The connector of claim 1, wherein the slit becomes narrow responsive to the walls being urged toward each other by a compression of the latched pieces.

3. The connector of claim 1, further comprising two abutment members each provided between the latched piece and the pivot bar, the abutment members each being urged against a rear corner of the respective indentation for firmly holding thereto.

4. The connector of claim 1, wherein the latched piece has a rounded head.

5. The connector of claim 1, wherein the holes in the indentation are not exposed to an outer surface of the shoulder.

* * * * *